US010108118B2

(12) United States Patent
Lee et al.

(10) Patent No.: US 10,108,118 B2
(45) Date of Patent: Oct. 23, 2018

(54) FUSING DEVICE HAVING A HEATING MEMBER WITH A HEAT SOURCE SEAT FOR MOUNTING A HEAT SOURCE

(71) Applicant: S-PRINTING SOLUTION CO., LTD., Suwon-si, Gyeonggi-do (KR)

(72) Inventors: Sun Hyung Lee, Yongin-si (KR); Sang Uk Jeon, Yongin-in (KR); Dong Woo Lee, Seoul (KR)

(73) Assignee: S-PRINTING SOLUTION CO., LTD., Suwon-si (KR)

( * ) Notice: Subject to any disclaimer, the term of this patent is extended or adjusted under 35 U.S.C. 154(b) by 0 days.

(21) Appl. No.: 15/921,256

(22) Filed: Mar. 14, 2018

(65) Prior Publication Data

US 2018/0203388 A1 Jul. 19, 2018

Related U.S. Application Data

(63) Continuation of application No. 15/334,748, filed on Oct. 26, 2016, now Pat. No. 9,952,541.

(30) Foreign Application Priority Data

Oct. 29, 2015 (KR) ..... 10-2015-0150909

(51) Int. Cl.
*G03G 15/20* (2006.01)

(52) U.S. Cl.
CPC ..... *G03G 15/2053* (2013.01); *G03G 15/2064* (2013.01); *G03G 2215/2035* (2013.01)

(58) Field of Classification Search
CPC ..... G03G 15/2053; G03G 15/2064; G03G 2215/2016; G03G 2215/2035
See application file for complete search history.

(56) References Cited

U.S. PATENT DOCUMENTS

| | | | |
|---|---|---|---|
| 5,860,052 | A | 1/1999 | Ohtsuka et al. |
| 7,235,761 | B1 | 6/2007 | Maul et al. |
| 2002/0011476 | A1 | 1/2002 | Otsuka |
| 2007/0116502 | A1 | 5/2007 | Shimizu et al. |
| 2008/0304882 | A1 | 12/2008 | Shin et al. |
| 2014/0105634 | A1 | 4/2014 | Tanaka et al. |
| 2015/0023704 | A1 | 1/2015 | Imaizumi et al. |

FOREIGN PATENT DOCUMENTS

| | | |
|---|---|---|
| EP | 1 967 916 A1 | 9/2008 |
| EP | 2 746 860 A2 | 6/2014 |
| JP | 7-34037 | 2/1995 |
| JP | 9-319240 | 12/1997 |
| KR | 1998-033231 | 7/1998 |

*Primary Examiner* — Sophia S Chen
(74) *Attorney, Agent, or Firm* — Staas & Halsey LLP

(57) ABSTRACT

A fusing device and an image forming apparatus are described in which a pressing member and a heating member of the fusing device are disposed adjacent to one another in a first direction. The heating member includes a fusing belt having a first side in contact with the pressing member, a heat source, disposed at a second side of the fusing belt, to heat the fusing belt, and a heat source seat having a concave structure in which the heat source is mountable.

18 Claims, 13 Drawing Sheets

FUSING DEVICE HAVING A HEATING MEMBER WITH A HEAT SOURCE SEAT FOR MOUNTING A HEAT SOURCE

CROSS-REFERENCE TO RELATED APPLICATIONS

This application is a continuation of U.S. patent application Ser. No. 15/334,748, filed Oct. 26, 2016, which is currently pending, and claims the priority benefit of Korean Application No. 10-2015-0150909, filed Oct. 29, 2015, in the Korean Intellectual Property Office, the disclosures of each of which are incorporated herein by reference in their entirety.

BACKGROUND

Various examples of the disclosure relate to an image forming apparatus in which a structure of a fusing device is improved.

An image forming apparatus is a device for forming an image on a printing medium according to input signals, and examples thereof include printers, copiers, facsimiles, and all-in-one devices implemented by a combination thereof.

One type of an image forming apparatus, an electrophotographic image forming apparatus, includes a photosensitive unit having a photoreceptor therein, a charging unit which is disposed near the photosensitive unit and charges the photoreceptor to a predetermined potential level, a developing unit having a developing roller, and a light scanning unit. The light scanning unit applies light onto the photoreceptor charged to the predetermined potential level by the charging unit to form an electrostatic latent image on a surface of the photoreceptor, and the developing unit supplies developers onto the photoreceptor on which the electrostatic latent image is formed to form a visible image.

The visible image formed on the photoreceptor is directly transferred to the printing medium, or passes through an intermediate transfer material and then is transferred to the printing medium, and the visible image transferred on the printing medium is fused on the printing medium while passing through a fusing device.

Generally, a fusing device which is widely used includes a heat source, a heating member having a fusing belt disposed along the circumference thereof, and pressing members pressed against the fusing belt and to form a fusing nip. When a printing medium to which a toner image is transferred is moved between the fusing members and pressing members, the toner image is fused on the printing medium by heat transmitted from the fusing members and pressure applied by the fusing nip.

At this point, a position of a contact point between the heat source and a connector provided for supplying electricity to the heat source is changed because the heat source is deformed by heat at high temperature, and thus the position of the contact point between the heat source and the connector cannot be maintained constantly.

DETAILED DESCRIPTION

Figure 1:
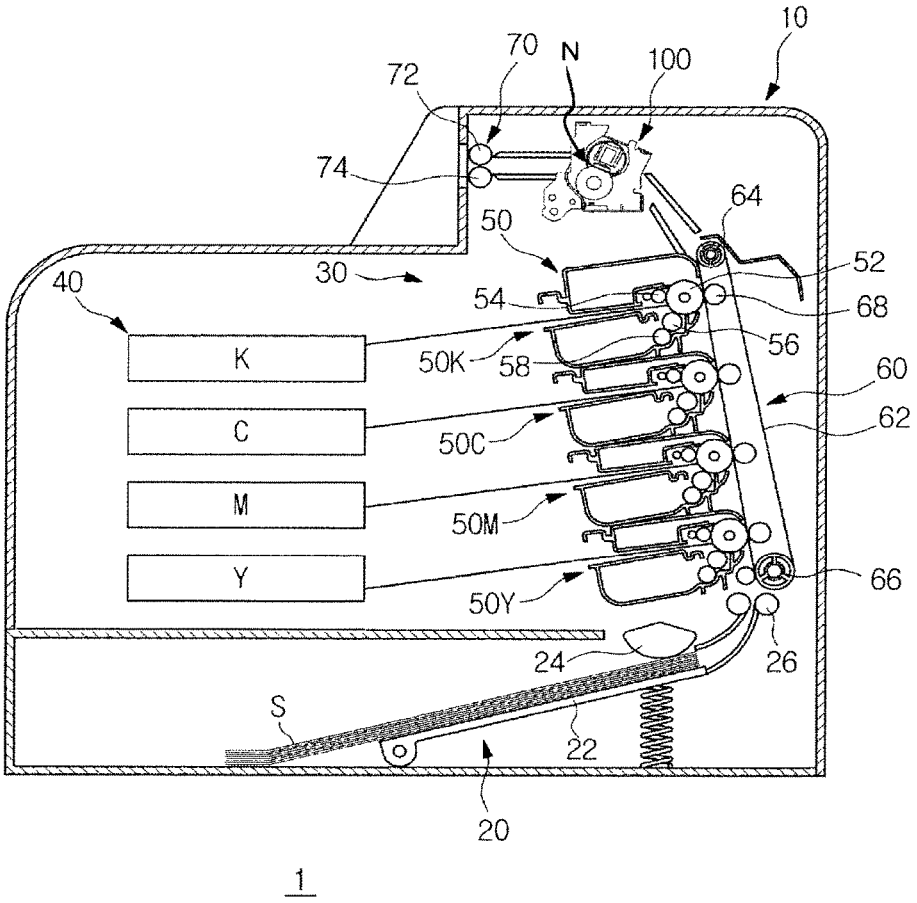
FIG. 1 is a view illustrating an example image forming apparatus according to the disclosure.

An aspect of the disclosure includes providing a fusing device capable of fixing a position of a heat source deformed by heat at high temperature in a heating member and an image forming apparatus having the same.

An aspect of the disclosure includes providing a fusing device capable of maintaining a contact point between a heat source and a connector by fixing a position of a heat source and an image forming apparatus having the same.

An aspect of the disclosure includes providing a fusing device capable of preventing damage on a heat source deformed by heat at high temperature and an image forming apparatus having the same.

An aspect of the disclosure includes providing a fusing device capable of reducing temperature ramp-up time for a heating member by reducing heat loss of a heat source and an image forming apparatus having the same.

Reference will now be made to examples of the disclosure which are illustrated in the accompanying drawings.

Also, like reference numerals or symbols provided in each of the drawings indicate components or elements performing the same functions.

Also, the terms used herein are merely to describe an example, and do not limit the disclosure. Further, unless the context clearly indicates otherwise, singular expressions should be interpreted to include plural expressions. It should be understood that the terms "comprises," "comprising," "includes" or "has" are intended to indicate the presence of features, numerals, steps, operations, elements and components described in the specification or the presence of combinations of these, and do not preclude the presence other features, numerals, steps, operations, elements and components, the presence of combinations of these, or additional possibilities.

Also, the terms including ordinal numbers such as "first," "second," etc. can be used to describe various components, but the components are not limited by those terms. The terms are used merely for the purpose of distinguishing one component from another. For example, a first component may be referred to a second component, and similarly, a second component may be referred to a first component without departing from the scope of rights of the disclosure.

The term "and/or" encompasses combinations of a plurality of items or any one of the plurality of items.

The terms "front-end," "back-end," "upper portion," "lower portion," "upper end," "lower end," and the like used in the below descriptions are defined based on the drawings, and shape and position of each component are not limited to the terms.

FIG. 1 is a view illustrating an example image forming apparatus 1 according to the disclosure.

As illustrated in FIG. 1, the image forming apparatus 1 includes a main body 10, a printing medium feeding device 20, a printing device 30, a fusing device 100, and a printing medium ejecting device 70.

The main body 10 may form an exterior of the image forming apparatus 1 and may also support various components installed therein. The main body 10 may include a cover (not shown) provided to open and close a part thereof and a main body frame (not shown) to support or fix various components in the main body 10.

The printing medium feeding device 20 delivers a printing medium S to the printing device 30. The printing medium feeding device 20 includes a tray 22 to load the printing medium S and a pick-up roller 24 to pick up the printing medium loaded on the tray 22 one sheet at a time. The printing medium S picked up by the pick-up roller 24 is delivered to the printing device 30 by a feeding roller 26.

The printing device 30 may include a light scanning device 40, a developing device 50, and a transferring device 60.

The light scanning device 40 includes an optical system (not shown) and projects beams corresponding to image information in colors of yellow Y, magenta M, cyan C, and black K to the developing device 50 in response to a printing signal.

The developing device 50 forms a toner image in response to image information input from an external device such as a computer, etc. The image forming apparatus 1 according to an example is a color image forming apparatus, and the developing device 50 may include four developing devices 50Y, 50M, 50C, and 50K to respectively accommodate toners having different colors, e.g., toners having colors of yellow Y, magenta M, cyan C and black K.

Each of the developing devices 50Y, 50M, 50C, and 50K may include a photoreceptor 52 to form an electrostatic latent image on a surface thereof using the light scanning device 40, a charging roller 54 to charge the photoreceptor 52, a developing roller 56 to deliver a toner image to the electrostatic latent image formed on the photoreceptor 52, and a feeding roller 58 to deliver toner to the developing roller 56.

The transferring device 60 transfers the toner image formed on the photoreceptor 52 to the printing medium S. The transferring device 60 may include a transfer belt 62 to forwardly move while being in contact with each photoreceptor 52, a transfer belt driving roller 64 to drive the transfer belt 62, a tension roller 66 to maintain tension in the transfer belt 62, and four transfer rollers 68 to transfer the toner image developed on the photoreceptor 52 to the printing medium S.

The printing medium S is attached to the transfer belt 62 and delivered at the same speed as the movement of the transfer belt 62. At this point, a voltage having polarity opposite that of toner attached to the photoreceptor 52 is applied to each transfer roller 68, and thus the toner image on the photoreceptor 52 is transferred to the printing medium.

The fusing device 100 fixes the toner image, which is transferred to the printing medium S by the transferring device 60, to the printing medium S. A detailed description of the fusing device 100 will be described below.

The printing medium ejecting device 70 discharges the printing medium S to the outside of the main body 10. The printing medium ejecting device may include an ejecting roller 72 and a pinch roller 74 installed to face the ejecting roller 72.

Figure 2:
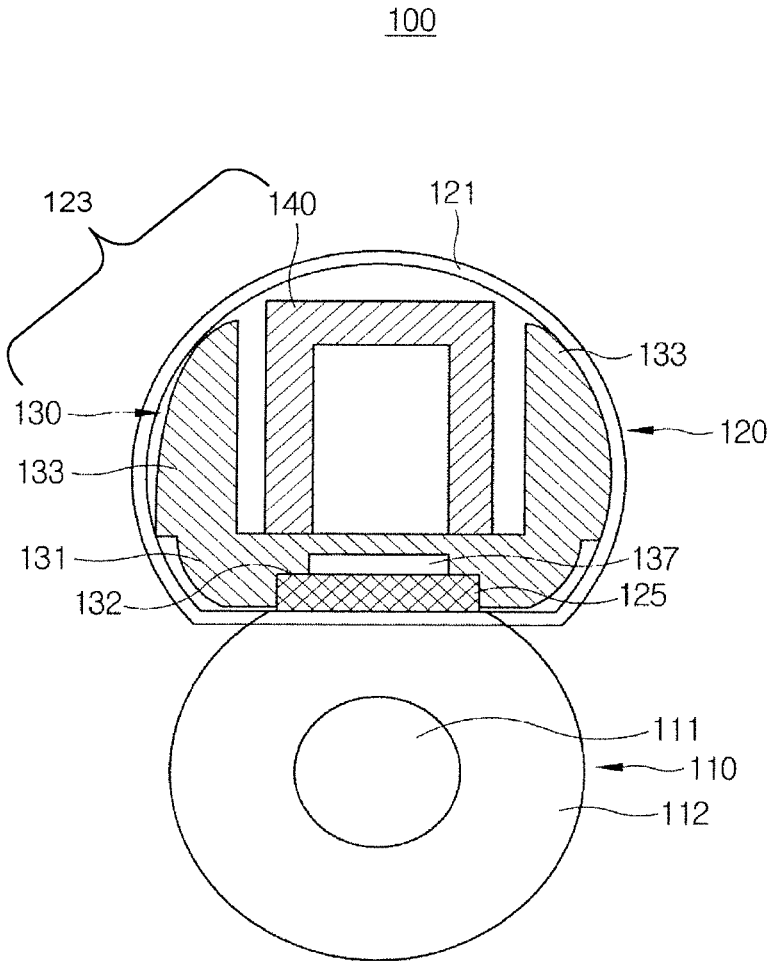
FIG. 2 is a schematic view illustrating an example fusing device of the image forming apparatus illustrated in FIG. 1.
Figure 3:
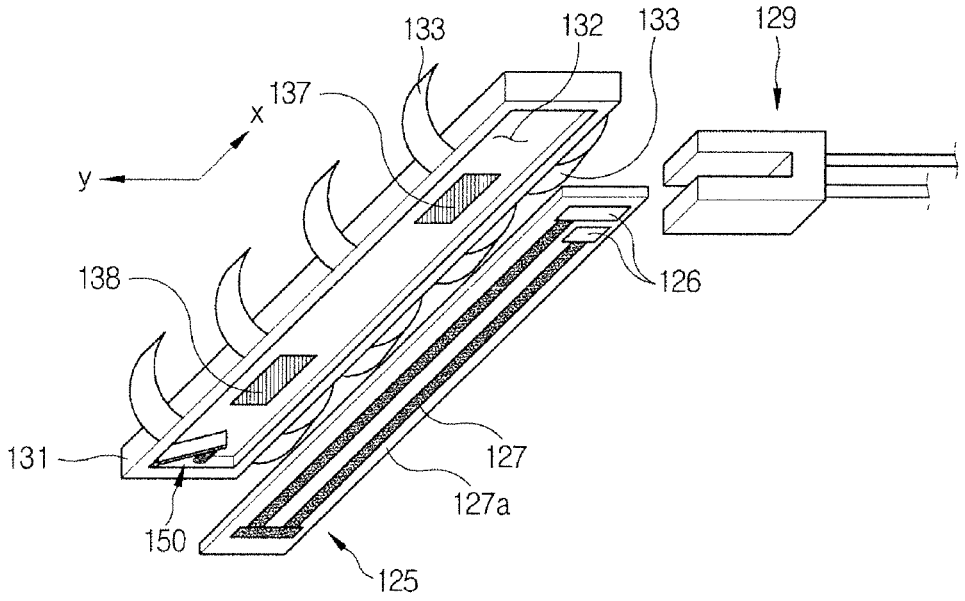
FIG. 3 is an exploded perspective view illustrating examples of a guide member, a heat source, and a connector illustrated in FIG. 2.
Figure 4:
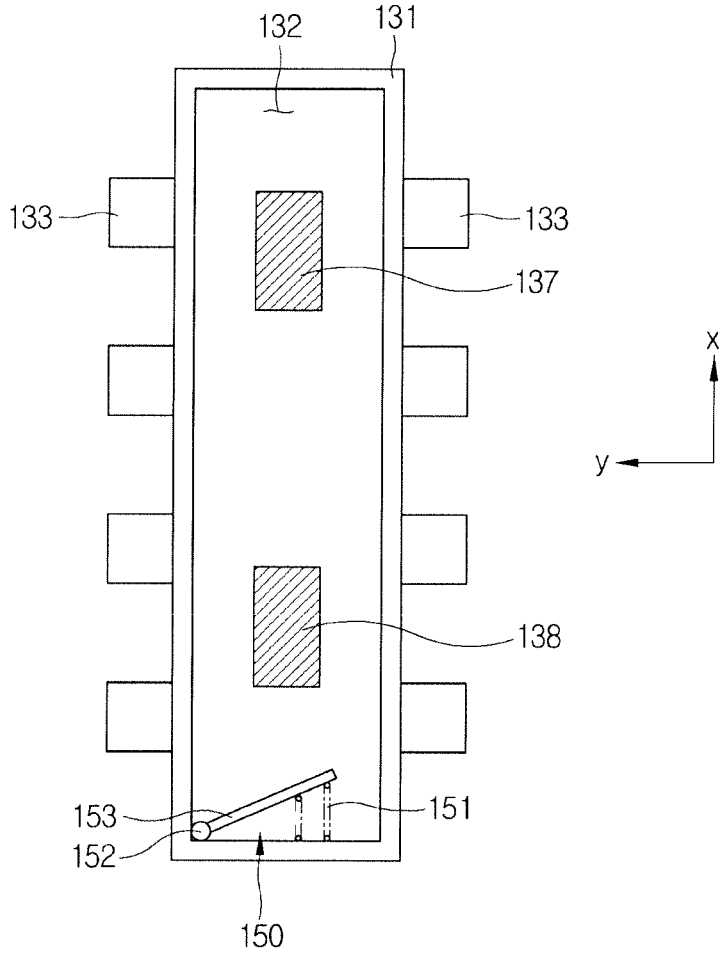
FIG. 4 is a bottom view of the example guide member illustrated in FIG. 3 when viewed from a lower side thereof.
Figure 5:
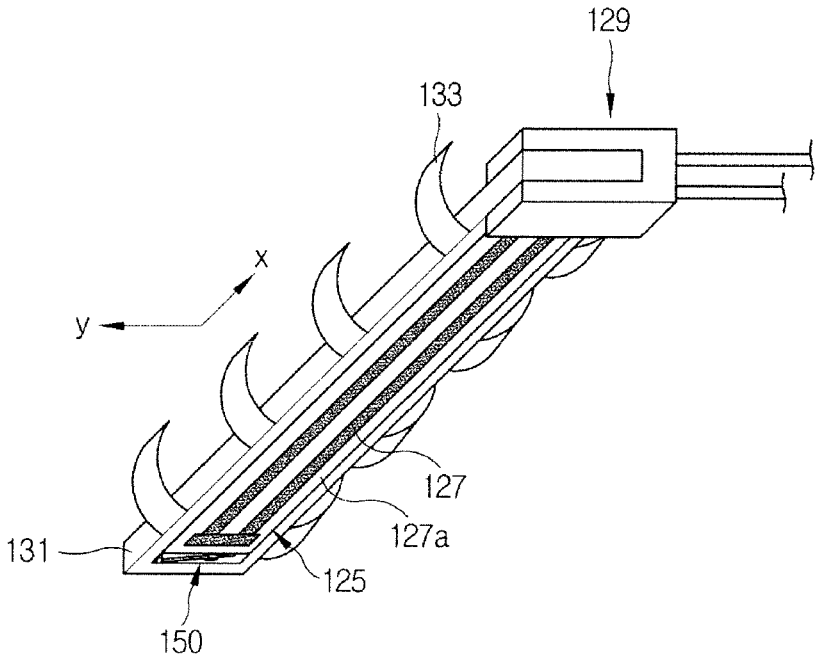
FIG. 5 is a perspective view illustrating an example coupling state of the guide member, the heat source, and connector illustrated in FIG. 3.
Figure 6:
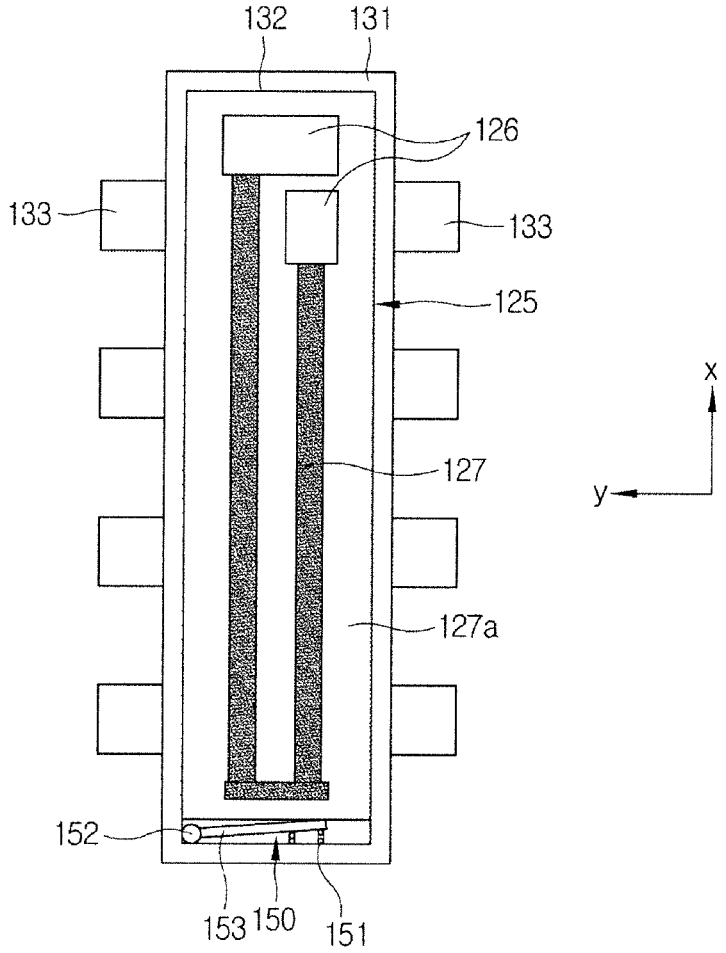
FIG. 6 is a bottom view illustrating the example coupling state of the guide member and the heat source illustrated in FIG. 5.

FIG. 2 is a schematic view illustrating the fusing device of the image forming apparatus 1 illustrated in FIG. 1. FIG. 3 is an exploded perspective view illustrating a guide member 130, a heat source 125, and a connector 129 illustrated in FIG. 2. FIG. 4 is a bottom view of the guide member 130 illustrated in FIG. 3 when viewed from a lower side thereof. FIG. 5 is a perspective view illustrating a coupling state of the guide member 130, the heat source 125, and connector 129 illustrated in FIG. 3. FIG. 6 is a bottom view illustrating a coupling state of the guide member 130 and the heat source 125 illustrated in FIG. 5.

Hereinafter, all of a width direction X of a printing medium S, a width direction X of a pressing member 110, a width direction X of a heating member 120 are defined as the same direction.

The fusing device 100 includes the pressing member 110 and the heating member 120.

A printing medium S to which a toner image is transferred passes between the pressing member 110 and the heating member 120, and at this point, the toner image is fixed to the printing medium S by heat and pressure.

The pressing member 110 may be disposed in contact with an outer circumferential surface of the heating member 120, and a fusing nip N may be formed between pressing member 110 and the heating member 120.

The pressing member 110 may be disposed to face the heating member 120, and the pressing member 110 together with an outer surface of the heating member 120 may form the fusing nip N. The pressing member 110 may include a shaft 111 formed of a metallic material, such as aluminum or steel, and an elastic layer 112 to form the fusing nip N between the pressing member 110 and the heating member 120 by being elastically deformed.

The elastic layer 112 is generally formed of silicone rubber. Hardness of the elastic layer 112 may be in a range of 50 to 80 based on a hardness reference of ASKER-C so that a high fusing pressure is applied to a printing medium S in the fusing nip N, and a thickness thereof may be in a range of 3 mm to 6 mm. The elastic layer 112 may be formed of a heat resistance material. A hetero layer (not shown) may be provided on a surface of the elastic layer 112 to prevent the printing medium S from being attached to the pressing member 110. The hetero layer may include a heat resistance resin film or a heat resistance rubber film.

The heating member 120 may include a fusing belt 121, a nip forming member 123, and a heat source 125.

The fusing belt 121 may be interconnected and rotated with the pressing member 110, the fusing belt 121 and the pressing member 110 form a fusing nip N, and the fusing belt 121 is heated by the heat source 125 to transmit heat to a printing medium S passing through the fusing nip N. A rotational center of the fusing belt 121 may be provided to be parallel to a rotational center of the pressing member 110. The fusing belt 121 may be an endless belt formed in a cylindrical shape. The fusing belt 121 may be with a single layer including a metal, a heat resistance polymer, etc. or formed by adding an elastic layer (not shown), which contains silicone rubber, fluorine rubber, or the like having high heat resistance, and a protection layer (not shown) onto a base layer (not shown) formed of a metal, such as aluminum, etc., or a heat resistance polymer. A hetero layer including perfluoroalkoxy (PFA), polytetrafluoroethylene (PTFE), fluorinated ethylene propylene (FEP) containing tetrafluoroethylene and hexafluoroethylene, or the like may be formed on an outer surface of the fusing belt 121. A thickness of the hetero layer may be in a range of 10 μm to 30 μm.

A base layer of the fusing belt 121 may be a heat resistance resin, such as polyimide, polyamide, polyimide-amide, etc., or a metal such as stainless (SUS), nickel, or copper, and a thickness thereof may be in a range of about 30 μm to 200 μm and, for example, in a range of 50 μm to 100 μm.

An inner surface of the fusing belt 121 may be painted black or treated with a black coating for expediting heat absorption.

The nip forming member 123 presses an inner circumferential surface of the fusing belt 121 to form a fusing nip N between the fusing belt 121 and the pressing member 110. The nip forming member 123 may be formed of a material having excellent strength, such as SUS, carbon steel, etc.

The nip forming member 123 includes a guide member 130 in contact with the inner surface of the fusing belt 121 for guiding the fusing belt 121 and a pressing unit 140 disposed above the guide member 130 for pressing and supporting the guide member 130.

When strength of the pressing unit 140 is low, the pressing unit 140 may not uniformly press the fusing nip N because bending deformation occurs significantly. Accordingly, a cross section of the pressing unit 140 may be provided in an arcuate shape to reduce the bending deformation.

The guide member 130 may be provided inside the fusing belt 121 to guide rotation of the fusing belt 121. The guide member 130 may be provided in contact with the inner surface of the fusing belt 121 to guide the rotation of the fusing belt 121. The guide member 130 may be in contact with the inner surface of the fusing belt 121 to form a fusing nip N and guides the fusing belt 121 so that the fusing belt 121 smoothly moves near the fusing nip N.

The heat source 125 may be disposed under the guide member 130. The guide member 130 may include a member body 131 disposed inside the fusing belt 121 in a width direction X and a heat source seat 132.

The heat source seat 132 may be concavely formed so that the heat source 125 is disposed under the guide member 130. The heat source seat 132 may be concavely formed in the member body 131 in the width direction X. The heat source seat 132 may have a rectangular shape extending in the width direction X of the heating member 120.

A size of the heat source seat 132 may be increased to a preset size greater than a size of the heat source 125 in the width direction X of the heating member 120 to have a surplus space even when the heat source 125 is mounted thereon. Since the heat source 125 is heated and expands and/or is deformed, the heat source seat 132 having the increased size is needed for preventing damage to the heat source 125 in the heat source seat 132. Furthermore, since the heat source seat 132 may be manufactured to be larger than the heat source 125, the heat source 125 may be easily assembled with the heat source seat 132, and thus productivity of products can be improved.

The guide member 130 may include belt guides 133. The belt guides 133 may be provided to guide rotation of the fusing belt 121. The belt guides 133 may be formed to be in contact with the inner surface of the fusing belt 121 and may be provided as a plurality of belt guides. The plurality of belt guides 133 may be formed extending from the member body 131 and disposed separately from each other.

The guide member 130 may further include a pressing support member 150 provided at the heat source seat 132.

The pressing support member 150 may be provided at one side of the heat source seat 132 and press the heat source 125 toward the other side opposite the one side of the heat source seat 132. The pressing support member 150 may include an elastic body 151 provided to generate a force by which the heat source 125 is pressurized.

As illustrated in FIG. 4, the elastic body 151 is in an extended state when the heat source 125 is not disposed on the heat source seat 132, and as illustrated in FIG. 6, the elastic body 151 is in a compressed state when the heat source 125 is mounted on the heat source seat 132. As illustrated in FIG. 6, when the heat source 125 is mounted on the heat source seat 132, in the heat source seat 132, the elastic body 151 may press the heat source 125 toward the other side opposite the one side where the pressing support member 150 is provided. Accordingly, one side surface of the heat source 125 is in contact with an inner surface of the heat source seat 132. The elastic body 151 is illustrated as a coil spring in FIGS. 3 and 4, but the disclosure is not limited thereto.

The pressing support member 150 may further include a hinge 152 and a supporting member 153. One end of the supporting member 153 may be connected to the elastic body 151, and the other end may be connected to the hinge 152. The hinge 152 may be fixed to the guide member 130.

According to the above configuration, the supporting member 153 may rotate about the hinge 152. When the heat source 125 is not disposed on the heat source seat 132 as illustrated in FIG. 4, the elastic body 151 is in an extended state, and when the heat source 125 is disposed on the heat source seat 132 as illustrated in FIG. 6 and the elastic body 151 is compressed, the supporting member 153 rotates clockwise about the hinge 152. When the heat source 125 moves away from the heat source seat 132, i.e., the state shown in FIG. 4 is changed to the state shown in FIG. 6, the elastic body 151 returns to the extended state, and the supporting member 153 rotates counter-clockwise about the hinge 152.

Referring to FIGS. 3 and 4, the guide member 130 may include a temperature sensor 137 and/or a temperature controller 138 provided adjacent to the heat source 125.

The temperature sensor 137 may include a thermistor. The temperature sensor 137 measures a temperature of the heat source 125 and the measured temperature is transmitted to a controller (not shown) so that the controller may control driving state of the image forming apparatus 1. For example, when a temperature of the heat source 125 is higher than a reference temperature, the temperature sensor 137 measures the temperature of the heat source 125 and transmits the measured temperature to the controller, and the controller may control the image forming apparatus 1 so that idling of the fusing device 100 may be performed for cooling.

The temperature controller 138 may be a thermostat. When the temperature of the heat source 125 is increased to a predetermined temperature or higher, the temperature controller 138 stops supply of electricity to the heat source 125 so that the heat source 125 does not generate heat any more. The temperature controller 138 may include a bimetal.

The heat source 125 may be disposed to directly radiate heat onto at least a part of the inner surface of the fusing belt 121. The heat source 125 may be inserted into the heat source seat 132, which will be described below, and disposed to face the fusing belt 121. Since the heat source 125 may be disposed to directly transmit heat from a lower portion of the member body 131 to the fusing belt 121, heat loss can be reduced, and thus heat transfer efficiency can be improved.

The heat source 125 may include a heating layer (not shown) and insulating layers (not shown). A pair of the insulating layers may be disposed on and under the heating layer. A ceramic material including Al203, AlN, or the like or a metal material including Ag—Pd alloy or the like may be applied to the heating layer. The heating layer may include an electrode 126 to which a connector 129 is connected for supplying electricity and a heater 127 to generate heat using the electricity received through the electrode 126.

The electrode 126 may be provided at one side of the heat source 125 separated from the pressing support member 150. When the heat source 125 is mounted on the guide member 130 and connected to the connector 129, the electrode 126 may receive electricity through the connector 129.

The heater 127 generates heat using electricity received through the electrode 126. The heater 127 may be formed extending in the width direction X of the heating member 120. The heater 127 may be manufactured as a pattern by screen-printing Ag—Pd particle material on the heat source body 127*a* formed of a ceramic material and sintering the resultant heat source body 127*a*. Although not shown, the above-described insulating layer may be provided on the pattern of the heater 127. The heater 127 may be formed as two lines extending in the width direction X of the heating member 120 as illustrated in FIG. 3 but is not limited thereto.

As illustrated in FIGS. 5 and 6, the heat source 125 may be mounted on the heat source seat 132. The pressing support member 150 may press the heat source 125 so that the elastic body 151 is changed from a compressed state to an extended state. Accordingly, the heat source 125 comes into contact with an inner surface of the other side of the heat source seat 132 opposite the one side where the pressing support member 150 may be provided.

According to the above configuration, in the image forming apparatus 1 according to an example of the disclosure, in the fusing device 100, a connecting position where the electrode 126 is connected to the connector 129 may be fixed even when the heat source 125 is heated and thus expends and/or is deformed. Because the connecting position where the electrode 126 is connected to the connector 129 is fixed, damage on the electrode 126 can be prevented, and lifetime of the fusing device 100 may extend. Furthermore, a fire risk caused by connecting failures can be removed.

Figure 7:
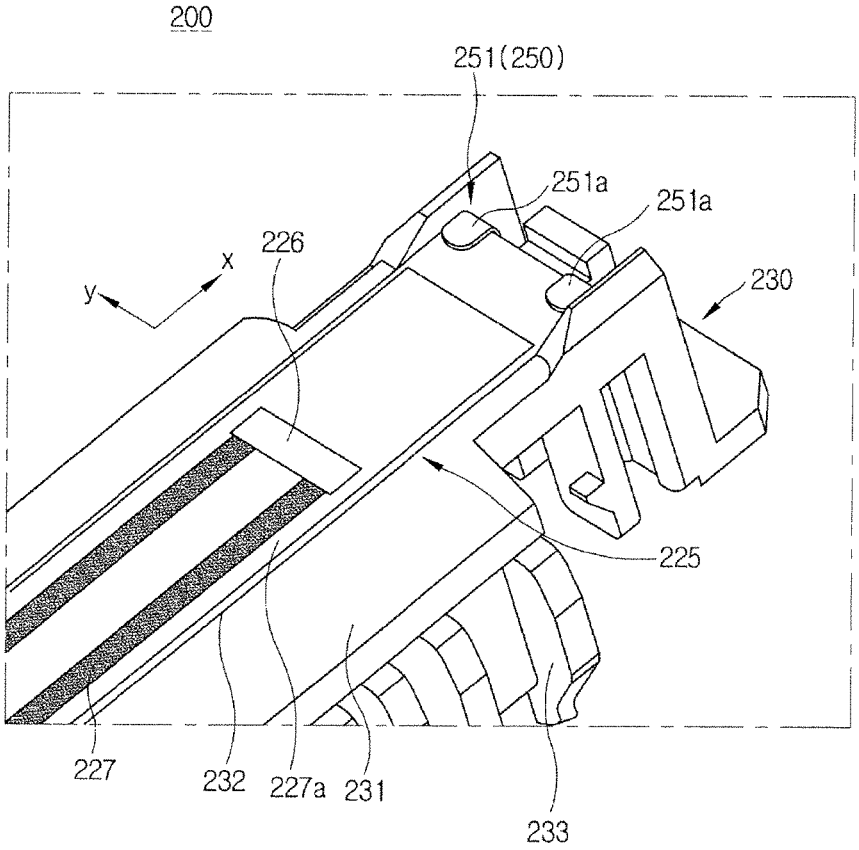
FIG. 7 is a view illustrating an example fusing device according to the disclosure.
Figure 8:
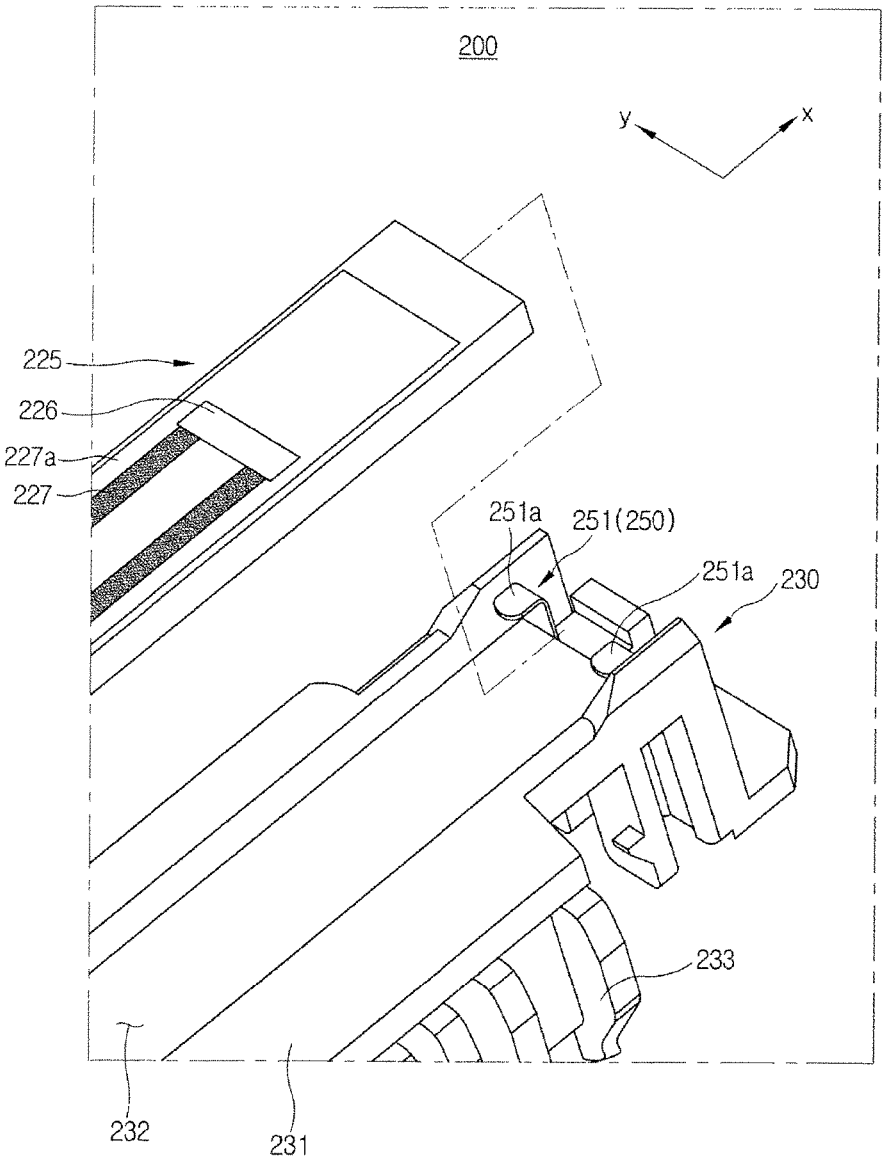
FIG. 8 is an exploded perspective view illustrating examples of a guide member and a heat source illustrated in FIG. 7.

FIG. 7 is a view illustrating a fusing device 200 according to an example of the disclosure. FIG. 8 is an exploded perspective view illustrating a guide member 230 and a heat source 225 illustrated in FIG. 7.

The fusing device 200 according to an example of the disclosure is described with reference to FIGS. 7 and 8. However, the same reference characters as those illustrated in FIGS. 3 to 6 will be respectively assigned to the same components in FIGS. 7 and 8, and descriptions thereof will be omitted.

A pressing support member 250 of the fusing device 200 may include leaf springs 251. Two leaf springs 251 may be provided as illustrated in FIG. 7, or one or three or more leaf springs 251 may also be provided. That is, the number of leaf springs 251 may be varied.

The leaf spring 251 may be provided at one side of a body 231 of the guide member 230 and may apply a force to the other side opposite the one side of the body 231. According to an example configuration, when the heat source 225 is mounted on the heat source seat 232, the leaf spring 251 presses the heat source 225 toward the other side opposite the one side, where the leaf spring 251 of the heat source seat 232 is provided, so as to fix a position of the heat source 225 at the other side. By fixing the position of the heat source 225, an electrode 226 of the heat source 225 may maintain a connecting position where the electrode 226 is connected to the connector 129. Accordingly, a heater 227 provided on a heat source body 227*a* may generate heat.

Similar to the example illustrated in FIG. 3, the guide member 230 may include a belt guide 233.

The leaf spring 251 may include a fixing portion 251*a* formed to be bent at one end thereof to face the pressing member 110. When the heat source 225 is mounted on the heat source seat 232, the fixing portion 251*a* may support the heat source 225 in an inward direction of the heat source seat 232. When a pressing pressure of the pressing member 110 is released, the fixing portion 251*a* prevents the heat source 225 from drooping in a direction of gravity, and thus, when a paper sheet is discharged, damage to the fusing belt 121 due to drooping of the heat source 225 may be prevented.

Figure 9:
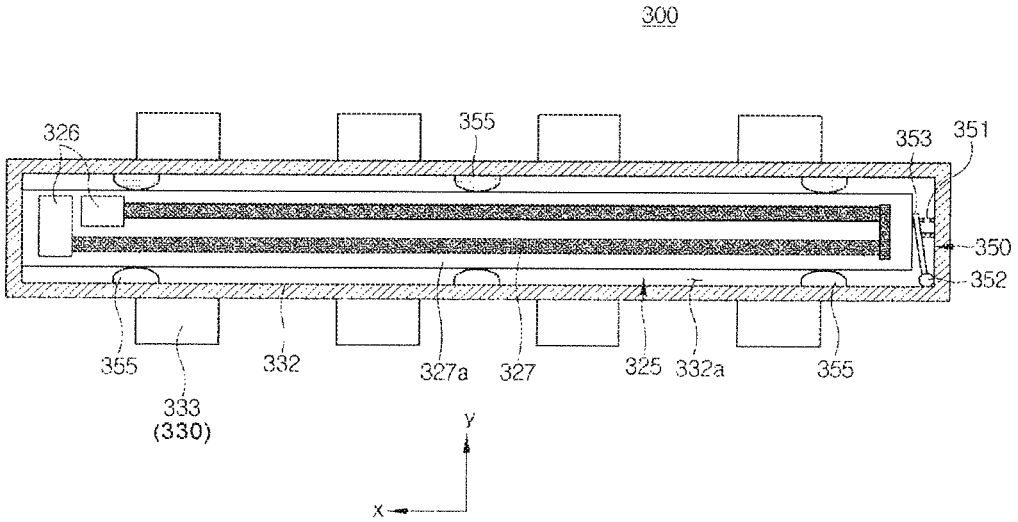
FIG. 9 is a view illustrating an example fusing device according to the disclosure.

FIG. 9 is a view illustrating a fusing device 300 according to an example of the disclosure. The fusing device 300 according to an example of the disclosure is described with reference to FIG. 9. However, the same reference characters as those illustrated in FIGS. 3 to 6 will be respectively assigned to the same components as those in FIG. 9, and descriptions thereof will be omitted.

As illustrated in FIG. 1, in the fusing device 300, a size of a heat source seat 332 may be greater than a size of a heat source 325 in a direction perpendicular to the width direction X of the heating member 120, i.e., a delivery direction (a Y direction) of a printing medium S as well as in the width direction X thereof. A heat source 325 may be more easily assembled with the heat source seat 332, and thus, manufacturing productivity can be increased. However, since the heat source 325 may be heated and expands and/or is deformed, the heat source 325 may move within the surplus space 332*a* of the heat source seat 332, and thus a contact point between an electrode 326, and the connector 129 may not be properly maintained.

The fusing device 300 according to the example illustrated in FIG. 9 includes elastic members 355 disposed on the heat source seat 332. The elastic member 355 may be fluorine rubber or silicone rubber. The illustrated number of the elastic members 355 in FIG. 9 is three, provided at each of both sides of the heat source 325 in the Y direction, but the number of elastic members 355 is not limited thereto. The plurality of elastic members 355 may elastically support the heat source 325 in a direction from the both sides (in the Y direction) of the heat source 325 to between both sides facing each other. Accordingly, even when the heat source 325 generates heat and expands and/or is deformed, a position of the heat source 325 may be fixed at a position of a contact point between the heat source 325 and the connector 129. Furthermore, damage caused by collision of the heat source 325 with inner surfaces of the heat source seat 332 disposed on the both sides (in the Y direction) of the heat source 325 can be prevented.

In the fusing device 300 according to the example illustrated in FIG. 9, the connector 129 comes into contact with the electrode 326, electricity flows in a heater 327, and the heater 327 generates heat, similar to that in the example illustrated in FIG. 3. The heater 327 may be provided on a heat source body 327*a*. The fusing device 300 may include a pressing support member 350 to press the heat source 325 toward one side where the electrode 326 is provided. The pressing support member 350 may include an elastic body 351, a hinge 352, and a supporting member 353, similar to that in the example illustrated in FIG. 3. Furthermore, a guide member 330 may include a belt guide 333.

Figure 10:
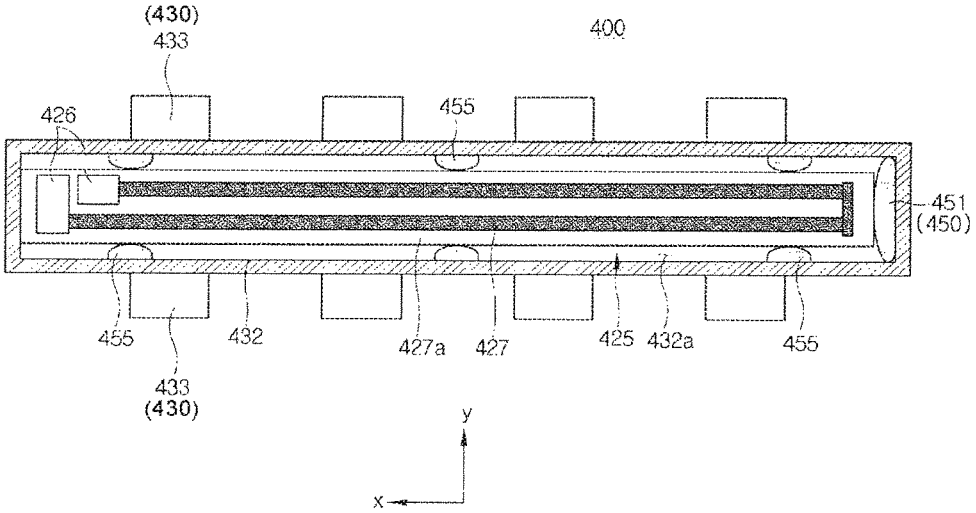
FIG. 10 is a view illustrating an example fusing device according to the disclosure.

FIG. 10 is a view illustrating a fusing device 400 according to an example of the disclosure.

The fusing device 400 according to an example of the disclosure is described with reference to FIG. 10. However, the same reference characters as those illustrated in FIGS. 3 to 6 will be respectively assigned to the same components as those in FIG. 10, and descriptions thereof will be omitted.

The fusing device 400 may include a plurality of elastic members 455 provided at both sides (a Y direction) of a heat source 425, similar to the elastic members 355 in the example illustrated in FIG. 9. The elastic members 455 may be disposed in a surplus space 432*a* between the heat source 425 and an inner surface of a heat source seat 432. Furthermore, in the fusing device 400, a pressing support member 450 may also be provided with elastic members 451 which are the same as the plurality of elastic members 455. That is, the fusing device 400 includes the plurality of elastic members 451 and 455 to elastically support side surfaces of the heat source 425 except one side where an electrode 426 of the heat source 425 is provided.

Accordingly, when the heat source 425 is mounted on the heat source seat 432, the plurality of elastic members 451 and 455 press and fix the heat source 425 in three directions so that a state in which the one side where the electrode 426 is provided is in contact with the inner surface of the heat source seat 432 is maintained.

In the fusing device 400 according to the example illustrated in FIG. 10, similar to that in the example illustrated in FIG. 3, the connector 129 comes into contact with the electrode 426, electricity flows in a heater 427, and the heater 427 generates heat. The heater 427 may be provided on a heat source body 427*a*. A guide member 430 may include a belt guide 433.

Figure 11:
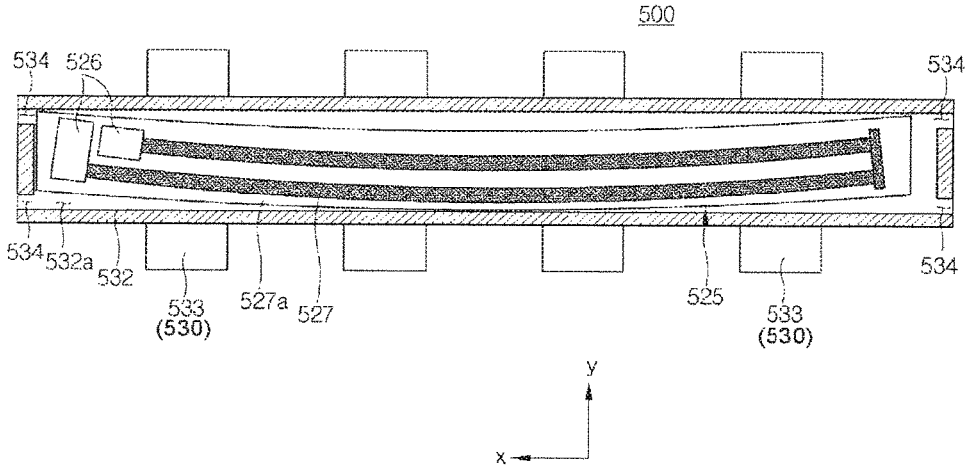
FIG. 11 is a view illustrating an example fusing device according to the disclosure.

FIG. 11 is a view illustrating a fusing device 500 according an example of the disclosure.

The fusing device 500 according to an example of the disclosure will be described with reference to FIG. 11. However, the same reference characters as those illustrated in FIGS. 3 to 6 will be respectively assigned to the same components as those in FIG. 11, and descriptions thereof will be omitted.

A heat source seat 532 of the fusing device 500 may include an opening 534 formed so that a corner portion of one side surface thereof is open.

When the heat source 525 expands and/or is deformed in the heat source seat 532, a corner portion of the heat source 525 collides with the corner portion of the heat source seat 532, and thus, the corner portion of the heat source 525 is damaged.

In the fusing device 500 according to the example illustrated in FIG. 11, since the corner portion of the heat source seat 532 is provided with the opening 534, even when the heat source 525 generates heat and expands and/or is deformed, the corner portion of the heat source 525 dose not collide with the heat source seat 532 due to the opening 534 of the heat source seat 532. Accordingly, the opening 534 prevents damage on the heat source 525, and thus lifetime of the heat source 525 can be increased.

In the fusing device 500 according to the example illustrated in FIG. 11, similar to that in the example illustrated in FIG. 3, the connector 129 comes into contact with an electrode 526, electricity flows in a heater 527, and the heater 527 generates heat. The heater 527 may be provided on a heat source body 527*a*. A guide member 530 may include a belt guide 533. Further, the heat source seat 532 may include a surplus space 532*a*.

Figure 12:
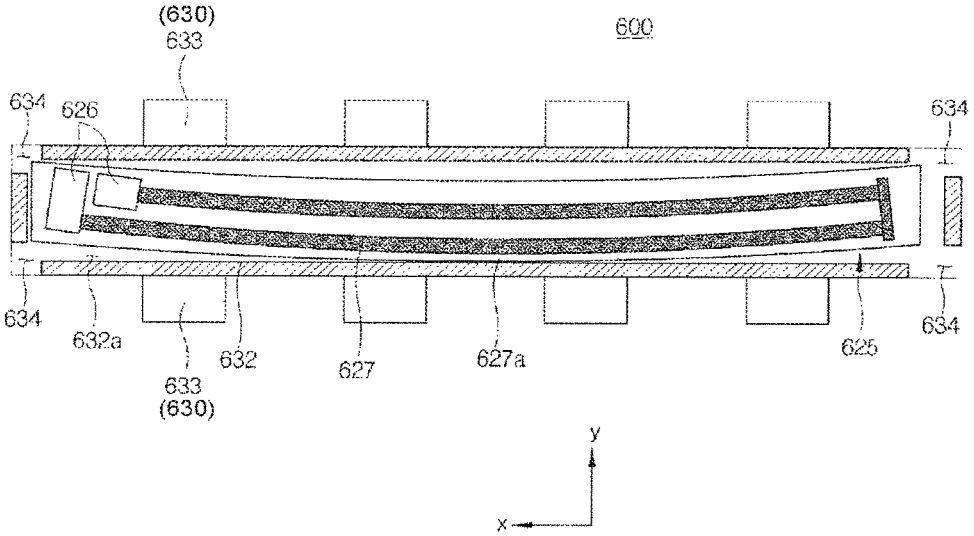
FIG. 12 is a view illustrating an example fusing device according to the disclosure.

FIG. 12 is a view illustrating a fusing device 600 according to an example of the disclosure.

The fusing device 600 according to an example of the disclosure will be described with reference to FIG. 12. However, the same reference characters as those illustrated in FIGS. 3 to 6 will be respectively assigned to the same components as those in FIG. 12, and descriptions thereof will be omitted.

A heat source seat 632 of the fusing device 600 may include an opening 634 formed so that both side surface of a corner portion thereof are open. When both side surfaces of the corner portion of the heat source seat 632 are open for the opening 634, a collision possibility of the corner portion of the heat source 625 with the heat source seat 632 is more decreased than in the case in which only one side surface is open for the opening 534 as shown in FIG. 11. Accordingly, the opening 634 prevents damage to the heat source 625, and lifetime of the heat source 625 can be increased.

In the fusing device 600 according to the example illustrated in FIG. 12, similar to that in the example illustrated in FIG. 3, the connector 129 comes into contact with an electrode 626, electricity flows in a heater 627, and the heater 627 generates heat. The heater 627 may be provided on a heat source body 627*a*. A guide member 630 may include a belt guide 633. Further, the heat source seat 632 may include a surplus space 632*a*.

Figure 13:
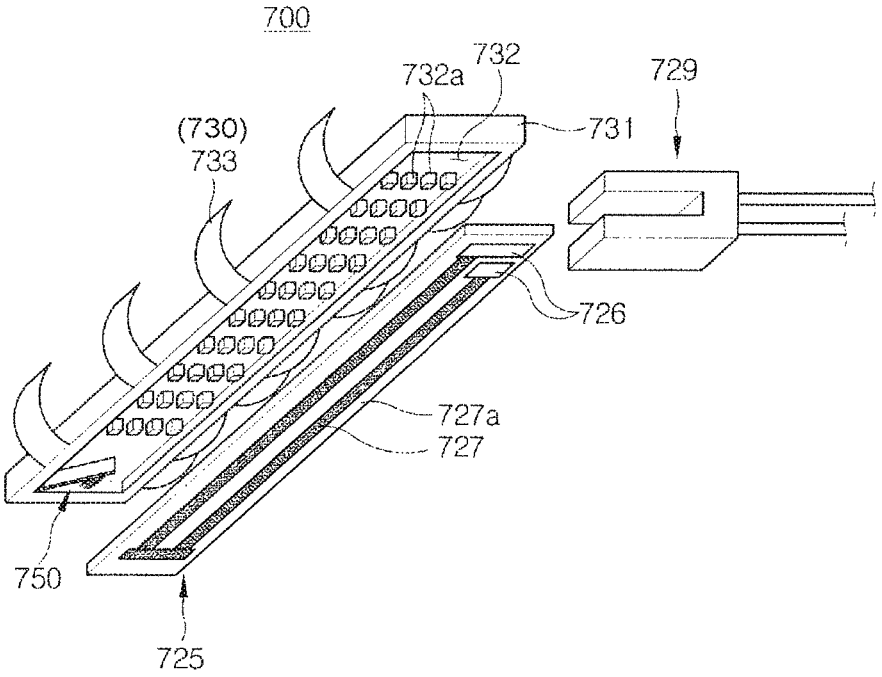
FIG. 13 is a view illustrating an example fusing device according to the disclosure.

FIG. 13 is a view illustrating a fusing device 700 according to an example of the disclosure.

The fusing device 700 according to an example of the disclosure will be described with reference to FIG. 13. However, the same reference characters as those illustrated in FIGS. 3 to 6 will be respectively assigned to the same components as those in FIG. 13, and descriptions thereof will be omitted.

Protrusions 732*a* may be provided on a surface of a heat source seat 732 of the fusing device 700 toward the pressing member 110. The protrusions 732*a* may be formed protruding a preset length from the surface on which a heat source 725 of the heat source seat 732 is mounted. FIG. 13 illustrates that the plurality of protrusions in a square pillar shape are provided in a width direction X, but the shape and the number of protrusions are not limited thereto.

The heat source 725 may be in contact with the protrusions 732*a* and mounted on the heat source seat 732. Since the heat source 725 has to transmit heat to the fusing belt 121 disposed on one side opposite the other side in contact with the protrusions 732*a*, it indicates that heat loss occurs when heat is transmitted to the side surface where the protrusions 732*a* are provided.

In the fusing device 700 illustrated in FIG. 13, a contact area between the heat source 725 and the heat source seat 732 is decreased due to the protrusions 732*a*, and thus, an amount of heat transmitted to the heat source seat 732 is also decreased. That is, heat loss can be decreased. Furthermore, the entire fusing belt 121 may be uniformly pressurized due to the protrusions 732*a* dispersed uniformly.

In the fusing device 700 according to the example illustrated in FIG. 13, similar to that in the example illustrated in FIG. 3, a connector 729 comes into contact with an electrode 726, electricity flows in a heater 727, and the heater 727 generates heat. The heater 727 may be provided on a heat source body 727*a*. A guide member 730 may include a member body 731, a heat source seat 732, and a belt guide 733. Further, similar to that in the example illustrated in FIG. 3, a pressing support member 750 to press the heat source 725 may be included.

As described above, the image forming apparatus 1 according to examples of the disclosure can maintain contact points between the heat sources, for example, heat sources 125, 225, 325, 425, 525, 625, and 725 and the connectors, for example, connectors 129 and 729, and thus damage to the heat sources, for example, heat sources 125, 225, 325, 425, 525, 625, and 725 can be prevented.

It is an aspect of the disclosure to provide a fusing device capable of fixing a position of a heat source deformed by heat at high temperature in a heating member and an image forming apparatus having the same.

It is an aspect of the disclosure to provide a fusing device capable of maintaining a contact point between a heat source and a connector by fixing position of a heat source and an image forming apparatus having the same.

It is an aspect of the disclosure to provide a fusing device capable of preventing damage to a heat source deformed by heat at high temperature and an image forming apparatus having the same.

It is an aspect of the disclosure to provide a fusing device capable of reducing a temperature ramp-up time of a heating member by reducing heat loss of a heat source and an image forming apparatus having the same.

Although various examples have been shown and described, changes may be made to these examples without departing from the principles and spirit of the disclosure, the scope of which is defined in the claims and their equivalents.

What is claimed is:

1. A fusing device, comprising:
- a pressing member; and
- a heating member, disposed adjacent to the pressing member in a first direction, the heating member including:
  - a fusing belt having a first side in contact with the pressing member,
  - a heat source, disposed at a second side of the fusing belt, to heat the fusing belt,
  - a heat source seat, having a concave structure in which the heat source is mountable, and
  - a pressing support member, disposed at a first side of the heat source seat, having an elastic body to generate a force to press the heat source in a second direction, transverse to the first direction, toward a second side of the heat source seat that is opposite the first side of the heat source seat.

2. The fusing device of claim 1, wherein the elastic body includes a coil spring.

3. The fusing device of claim 1, wherein the pressing support member includes:
- a supporting member having a first end connectable to the elastic body, and a second end hinge-coupled to the first side of the heat source seat.

4. The fusing device of claim 1, wherein the heat source includes an electrode.

5. The fusing device of claim 4, further comprising a connector connectable with the electrode to allow electricity to be supplied to the heat source.

6. The fusing device of claim 1, wherein the heating member further includes a guide member to guide rotation of the fusing belt, the guide member including:
- a member body elongated in the second direction, and
- a belt guide that extends from the member body to support an inner surface of the fusing belt.

7. The fusing device of claim 1, wherein the elastic body includes a leaf spring, the leaf spring including:
- a first portion, disposed at the first side of the heat source seat, to generate the force to press the heat source in the second direction toward the second side of the heat source seat, and
- a second portion, bent at an end of the first portion in the second direction, to support the heat source in the first direction so as to keep the heat source mounted inside the concave structure of the heat source seat.

8. The fusing device of claim 1, wherein the elastic body includes an elastic member disposed between a side surface of the heat source seat and a side surface of the heat source, when the heat source is mounted on the heat source seat.

9. The fusing device of claim 1, wherein the heat source seat includes a plurality of protrusions formed protruding from an inner surface of the heat source seat on which the heat source is mountable.

10. A fusing device, comprising:
- a pressing member; and
- a heating member, disposed adjacent to the pressing member to form a fusing nip, the heating member including:
- a fusing belt disposed to be in contact with the pressing member, and
- a heat source seat, having a rectangularly shaped concave structure in which a heat source to heat the fusing belt is mountable, and having an opening provided at a corner portion of the heat source seat.

11. The fusing device of claim 10, wherein
- the heating member is disposed adjacent to the pressing member in a first direction, and
- the heat source seat is elongated in a second direction transverse to the first direction and includes at least a first opening provided at a first corner portion of the heat source seat and a second opening provided at a second corner portion of the heat source seat.

12. An image forming apparatus, comprising:
- a main body;
- a developing device to form an image on a photoreceptor;
- a transferring device to transfer the image formed on the photoreceptor to a printing medium; and
- a fusing device to fuse the image, which is transferred to the printing medium by the transferring device, to the printing medium, the fusing device including:
  - a pressing member, and
  - a heating member, disposed adjacent to the pressing member in a first direction, the heating member including:
    - a fusing belt having a first side in contact with the pressing member,
    - a heat source, disposed at a second side of the fusing belt, to heat the fusing belt,
    - a heat source seat, having a concave structure in which the heat source is mountable, and
    - a pressing support member, disposed at a first side of the heat source seat, having an elastic body to generate a force to press the heat source in a second direction, transverse to the first direction, toward a second side of the heat source seat that is opposite the first side of the heat source seat.

13. The image forming apparatus of claim 12, wherein the heat source includes an electrode disposed on a side of the heat source that is closer to the second side of the heat source seat than the first side of the heat source seat.

14. The image forming apparatus of claim 12, wherein the elastic body includes a first elastic member, and a second elastic member is disposed at a third side of the heat source seat to press the heat source in a third direction, transverse to the first direction, toward a fourth side of the heat source seat that is opposite the third side of the heat source seat.

15. The image forming apparatus of claim 12, wherein the heat source includes:

an electrode, disposed on only one side of the heat source that is closer to the second side of the heat source seat than the first side of the heat source seat, to which a connector is connected to supply electricity, and a heater to generate heat using the electricity received through the electrode.

16. The image forming apparatus of claim 12, wherein the pressing support member is to press a first side of the heat source in the second direction such that a second side of the heat source contacts, and lies flush against, an inner surface of the second side of the heat source seat.

17. The image forming apparatus of claim 16, wherein a pressing support member is not disposed at the second side of the heat source seat.

18. The image forming apparatus of claim 12, wherein the heat source seat includes a plurality of protrusions formed protruding toward the pressing member in the first direction from an inner surface of the heat source seat on which the heat source is mountable.

* * * * *